US005186101A

United States Patent [19]

Murphy, III et al.

[11] Patent Number: 5,186,101

[45] Date of Patent: Feb. 16, 1993

[54] INK REPLENISHING SYSTEM

[75] Inventors: Charles F. Murphy, III, Fairfield; Patrick Murphy, Stamford, both of Conn.

[73] Assignee: Pitney Bowes Inc., Stamford, Conn.

[21] Appl. No.: 582,584

[22] Filed: Sep. 12, 1990

[51] Int. Cl.[5] ..... B41K 1/42

[52] U.S. Cl. ..... 101/97; 101/333; 101/324; 101/301; 101/338

[58] Field of Search ..... 101/97, 318, 98, 333, 101/101, 335, 108, 324, 301, 310, 338; 118/266, 264

[56] References Cited

U.S. PATENT DOCUMENTS

| | | | |
|---|---|---|---|
| 2,781,021 | 2/1957 | Schmitz | 118/264 |
| 2,828,715 | 4/1958 | Heyman et al. | 118/264 |
| 2,987,955 | 6/1961 | Sassenberg | 118/264 |
| 3,427,840 | 2/1969 | Richter | 118/266 |
| 3,739,717 | 6/1973 | Brown et al. | 101/366 |
| 3,795,351 | 3/1974 | Lehmann | 118/266 |
| 3,912,833 | 10/1975 | Decker | 118/266 |
| 4,023,485 | 5/1977 | Kirby, Jr. | 101/118 |
| 4,300,450 | 11/1981 | Gasparrini | 101/366 |
| 4,380,209 | 4/1983 | Reid et al. | 118/264 |
| 4,380,210 | 4/1983 | Auerbach | 118/264 |

*Primary Examiner*—Edgar S. Burr

*Assistant Examiner*—John S. Hilten

*Attorney, Agent, or Firm*—Charles G. Parks, Jr.; David E. Pitchenik; Melvin J. Scolnick

[57] ABSTRACT

The ink pad replenishing system includes an ink tray containing an ink pad, inlet means for receiving ink and outlet means for providing drainage of excess ink from the ink tray, and an ink reservoir. A first pump is comprised of a deformable and resilient tubular member, and first and second end caps fixably mounted to respective ends of the tubular member, and valve means mounted in the first pump for providing uni-directional flow in a first direction through the first pump upon actuation of the first pump. A second pump is comprised of a deformable and resilient tubular member, and first and second end caps fixably mounted to respective ends of the tubular member, and valve means mounted in the second pump or providing uni-directional flow in a second direction through the second pump upon actuation of the second pump. A first conduit is provided for providing flow communication between the reservoir, the first pump and the inlet means of said ink tray, and between the reservoir, the second pump and the outlet means of the ink tray. A reciprocally driven linkage is provided for periodically activating the first and second pumps.

7 Claims, 3 Drawing Sheets

INK REPLENISHING SYSTEM

BACKGROUND OF THE INVENTION

The present invention relates to systems for replenishing the ink supply to an ink pad.

Ink pads are used to ink an indicia plate for printing. In automated printing applications, it is necessary to replenish or replace the ink pad periodically. The frequency at which the ink pad requires replenishing is a function of the rate at which ink is removed from the pad by the indicia plate and the consistence of print quality required.

In automated system application such as postage meter printing systems where consistent print quality is required, it is a customary practice to provide the postage meter with a system for replenishing the ink pad after each print cycle. In order to ensure consistent print contrast without smears, conventional replenishing systems deliver replenishing in metered amount. It is also conventional to provide such replenishing system with suitable subsystems for the system operator to adjust the meter of the replenishing ink supplied to accommodate variation in the print surface of the postage meter print or indicia plate.

SUMMARY OF THE PRESENT INVENTION

It is an objective of the present invention to present a ink replenishing system which supplies ink to a ink pad at a constant rate and includes means for withdrawing excess ink from the pad, thereby maintaining a consistent amount of absorbed ink in the ink pad independent of variations in the print surface area of the indicia plate.

The ink replenishing system is comprised of a housing which supports an ink supply and reservoir bottle therein. The housing further supports a supply and drain pump. Each pump is comprised of a deformable tubular member with suitable inlet and outlet caps which enclose respective one way valves. Each pump includes one cap, inlet or outlet, which has a portion which protrudes into the ink bottle and a second cap, outlet or inlet, respectively, which is attached a hose connected to an ink tray. The supply pump includes a first and second one-way valve mounted in the respective inlet and outlet caps to direct flow from the ink bottle through the pump to the ink tray. In like manner, the drain pump includes a first and second one-way value mounted in the respective outlet and inlet caps to direct flow from the ink tray to the ink bottle. A displaceable linkage arrangement is provided such that one end of the linkage resides in a cam and upon rotation of the cam the linkage is caused to compress the deformable chambers of each pump and thereby motivate flow through the respective pumps.

DETAILED DESCRIPTION OF THE PREFERRED EMBODIMENT

Figure 1:
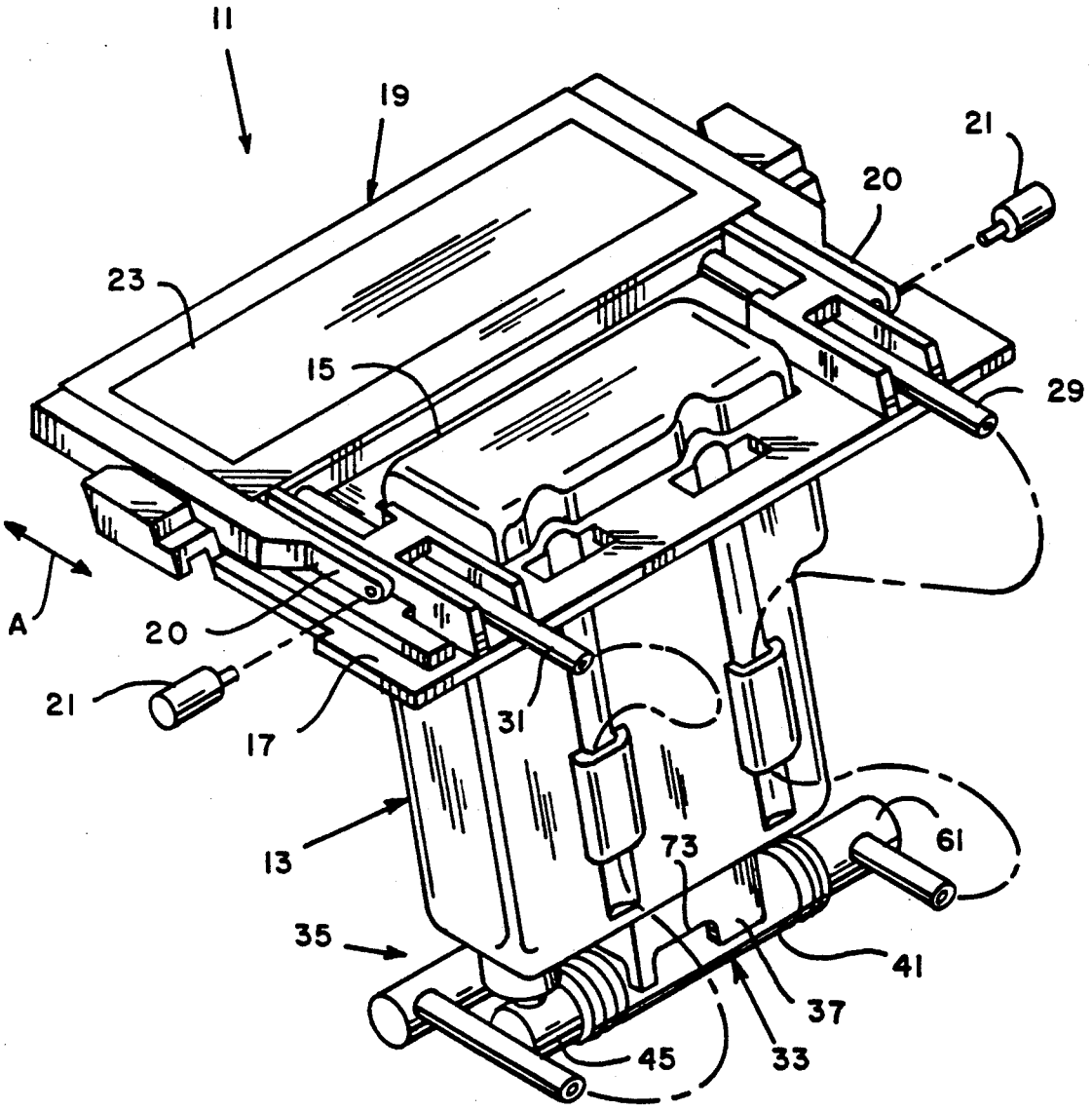
FIG. 1 is a perspective of the ink supply system in accordance with the present invention.

Referring to FIG. 1, the ink replenishing system, generally indicated as 11, is comprised of a housing 13 in which a detachable ink supply bottle 15 resides. The ink supply bottle contains a supply of print ink and serves as a ink reservoir. The housing 13 further includes a support rim 17 for slidably supporting an ink tray, generally indicated at 19. The ink tray 19 includes ink tray arms 20 which are attached to a prime mover 21 by any suitable means for providing reciprocal motion of the ink tray 19 as indicated by arrow A along the rim 17.

The ink tray 19 includes an ink pad 23, an inlet conduit 25 for supplying ink to the ink tray 19, and an outlet or drain conduit 27 for providing a pathway for draining excess ink from the ink tray and return the excess ink to supply bottle 15. One end of a inlet hose 29 is placed around the inlet conduit 25 and one end of a outlet hose 31 is placed around the outlet conduit 27. The other end of the inlet hose 29 is in communication with the outlet side of a supply pump 33. In like manner, the outlet hose 31 is in communication with a drain pump 35. The pumps 33 and 35 are detachably mounted to housing 13 by suitable support clamps 37.

The pump 33 is comprised of a tubular member 41 composed of an elastomer material such as Neopreure or Silicone. Resident within the tubular housing 41 is a fiberous rod 43 having fibers throughout its length which extend from the rod core to the inner walls of the tubular member 41. At one end of the tubular member 41 is an end cap 45 which defines a main passage way 47. Mounted in the main passage way 47 is a uni-directional apertured diaphragm 49 or other suitable pressure responsive value. The diaphragm 49 is held in place by a fitting 50. The end cap 45 also defines a passage way 51 which intersects passage way 47. Partially residing in passage way 51 is a hypodermic needle 53 having a blunted forward end. The hypodermic needle 53 has a needle opening 55 in the forward end for receiving ink from the supply bottle 15. The needle is injected into the supply bottle 15 through a sealing member 59.

A second end cap 61 is press mounted to the other end of tubular member 41. In like manner, the end cap 61 defines a main passage way 65. A fitting 67 secures a diaphragm 63 within the main passage way 65. The end cap 61 also includes a passage way 69 intersecting to passage way 65. The other end of supply hose 29 is press fit around a portion of end cap 61.

It should now be appreciated that compression of the tubular member 41 of the pump 33 will cause the diaphragm 49 to be compress closed by a portion of the ink or air present within the tubular member 41. At the same time, the diaphragm 63 will be forced open and a portion of the contained ink will be forced into the inlet house 29 to the ink tray 19. Upon release of the tubular member 41, a counter pressure is created in the tubular member 41 due to its resiliency causing the diaphragm 63 to close and the diaphragm 49 to open and, thereby, drawing ink from the supply bottle 15 through the needle 53 into the tubular member 41 until the tubular member 41 pressure is returned to ambient pressure. The pump 35 is identical to pump 33 with the exception that the diaphragm member 49 and 63 are oppositely oriented to their orientation in pump 33 to cause ink to flow from the tray 19 through into hose 31. Pump 35 operates in a similar manner to return ink and any entrapped air drained from the tray 19 to the ink supply bottle 15 for recirculation.

Figure 2:
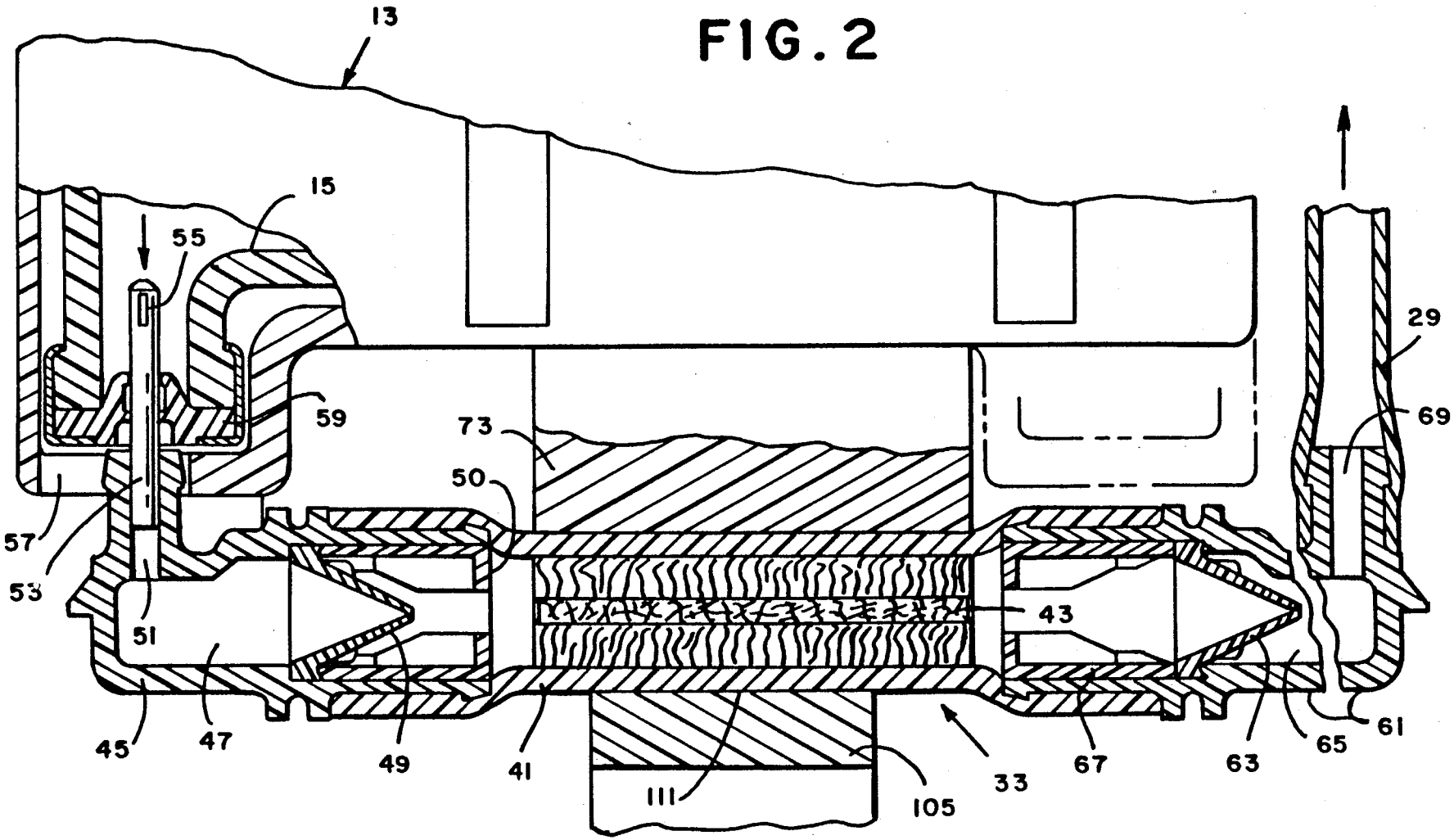
FIG. 2 is a sectioned view of a ink pump suitable for the ink supply system of the present invention.
Figure 3:
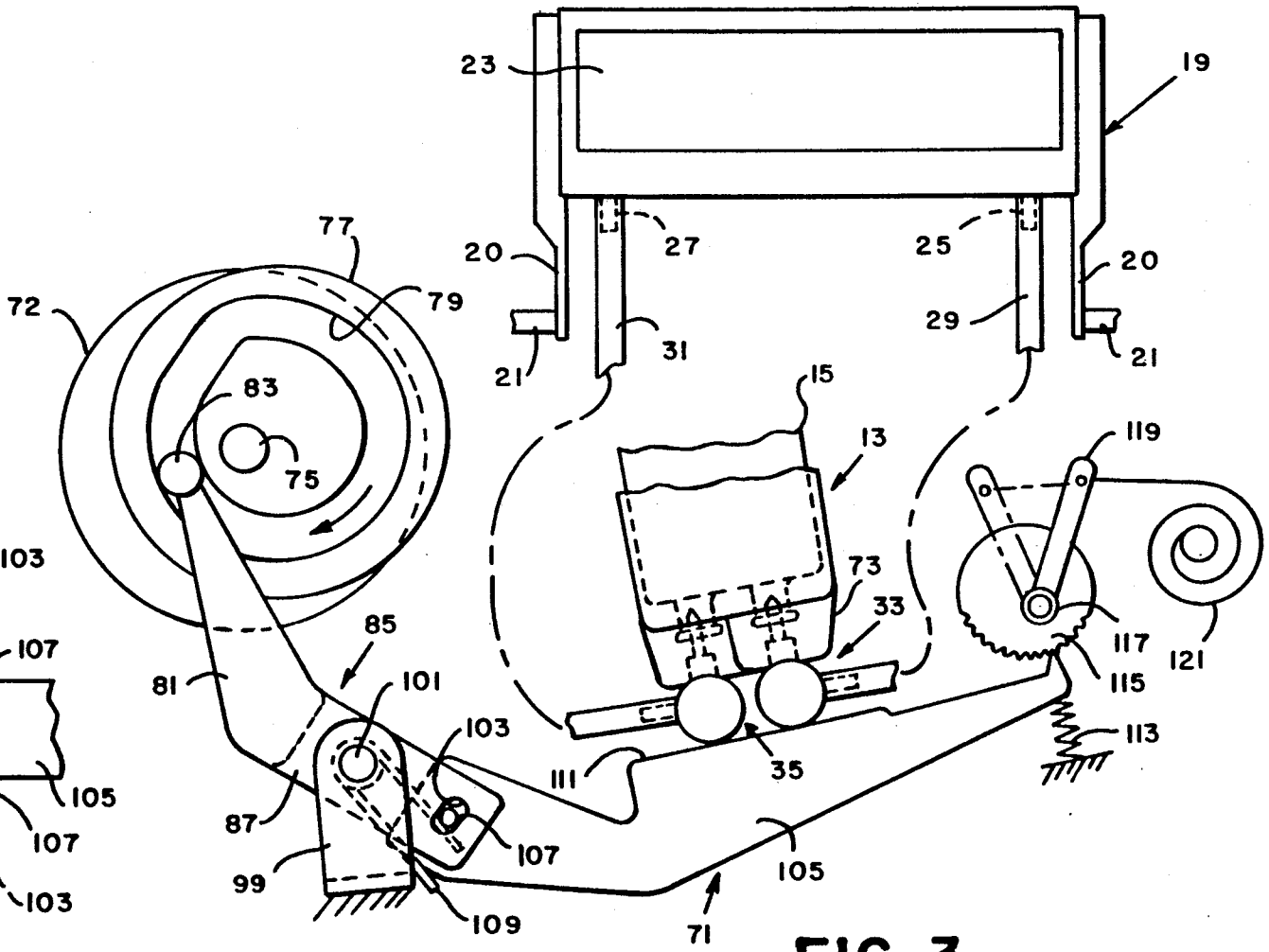
FIG. 3 is a schematic view of the ink pump actuating system in accordance with the present invention.
Figure 4:
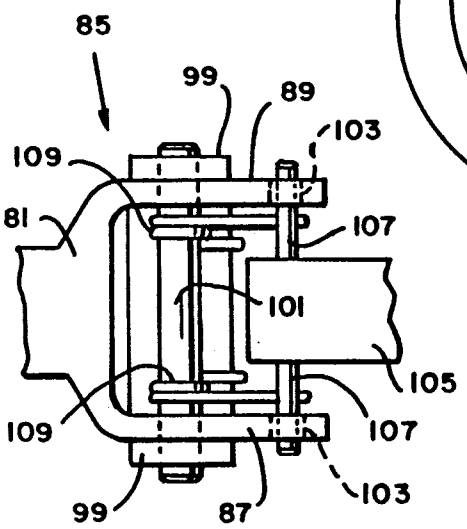
FIG. 4 is a sectioned view of the linkage coupling of the actuating system in accordance with the present invention.

Referring more particularly to FIGS. 3 and 4, actuation of the pumps 33 and 35 is provided by an actuator assembly 71 which compresses the respective tubular members 41 of pumps 33 and 35 against a counter member 73 (shown in FIG. 2) formed on the bottom of the housing 13. The actuator assembly 71 is comprised of a motor 72 having an output shaft 75 around which is mounted a cam 77. The cam 77 includes a cam track 79 in which a cam follower of the first link 81 resides. The link 81 has a yoked portion 85 formed at its other end having yoke arms 87 and 89. First and second support post 99 are fixably supported such that the yoke arms 87 and 89 are located between these support posts. A pivot shaft 101 extends through the support post 99 and the yoke arms 87 and 89. Each yoke arm contains an aligned slot 103.

A second link arm 105 is positioned between the yoke arms of the link 81 at one end, such that a pin 107 extending through and fixably mounted in that end of the second link 105 reside in the respective slots 103. A coil spring 109 is placed around the pivot shaft 101 such that the link 81 cam follower is biased against the inner surface of the cam track 79 and the link pin 107 is biased toward the forward end of slots 103. The second link 105 includes a flat 111 which is aligned to compress the tubular member 41 of the pumps 33 and 35 upon rotation of the motor 72. The other end of the link 105 is biased by a spring 113 against a ratchet asymmetric wheel 115 which is rotatably mounted on a hub 117. The wheel 115 includes a lever arm 119 such that displacement of the lever arm causes rotation displacement of the ratchet wheel. The lever arm 119 in turn is connected to a thermal spring 121 at one end such that thermal coil or uncoiling of the thermal spring 121 causes the lever arm to displace the asymmetric ratchet wheel.

It is now apparent to one reasonably skilled in the art that upon displacement of the motor 72, the cam 77 is caused to rotate causing the lever arm 81 to pivot about the pivot shaft 101. Pivotal displacement of the link 81 causes the second link 105 to displace and in so doing compress the tubular members 41 of respective pumps 33 and 35 against the member 73. Compression of pump 33 causes ink to be withdrawn from the ink supply container and to the ink tray 19 through the hose 29 as afore-described. The resupply system causes a positive delivery of ink to the ink tray while allowing excess ink to drain from the ink tray with the assistance of a back pressure caused by pump 35. As a result, the ink supply in the ink tray is caused to remain constant.

It should also be appreciated that the viscosity of the ink changes with ambient temperature, the higher the ambient temperature, the lower the ink viscosity and vise versa. As the ink viscosity increases, the ink flow rate increases through the pumps. Therefore, in order to maintain meter of the amount of ink in the ink tray 19, the theram responsive spring 113 expands or contacts resulting comprehensionally changing the actuation force applied to the pumps 33 and 35.

What is claimed is:

1. An ink pad replenishing system having an ink tray containing an ink pad, inlet means for receiving ink and outlet means for providing drainage of excess ink from said ink tray, and an ink reservoir, said system comprising:

communication means for delivering ink from said ink reservoir to said ink tray and for delivering from said ink tray to said ink reservoir;

a first pump means for providing a positive pressure in said communication means to cause ink to be withdrawn form said ink reservoir and delivered to said ink tray in a metered amount upon each actuation of said first pump means;

a second pump means for providing a back pressure in said communication means between said ink tray and said reservoir to motivate excess ink in said ink tray to return to said ink reservoir through said communication means;

activation means for periodically activating said first and second pumps.

2. An ink pad replenishing system as claimed in claim 1 further comprising thermo-responsive means for varying the pump pressure of said first and second pumps upon actuation in response to ambient system temperature.

3. An ink pad replenishing system having an ink tray containing an ink pad, inlet means for receiving ink and outlet means for providing drainage of excess ink from said ink tray and an ink reservoir, said system comprising:

a first pump having a deformable and resilient tubular member, first and second end caps fixably mounted to respective ends of said tubular member, and valve means mounted in said first pump for providing uni-directional flow in a first direction through said first pump upon actuation of said first pump;

a second pump having a deformable and resilient tubular member, first and second end caps fixably mounted to respective ends of said tubular member, and valve means mounted in said second pump for providing uni-directional flow in a second direction through said second pump upon actuation of said second pump;

communication means for providing fluid flow communication between said reservoir, said first pump and said inlet means of said ink tray, and between said reservoir, said second pump and said outlet means of said ink tray; and, activation means for periodically activating said first and second pumps.

4. An ink pad replenishing system as claimed in claim 3 wherein said activating means comprises means for compressibly deforming and releasing said tubular member of said first and second pumps.

5. An ink pad replenishing system as claimed in claim 4 further comprising thermo-responsive means for varying the compression of said tubular members by said activation means of said first and second pumps in response to variation in ambient temperature.

6. An ink pad replenishing system as claimed in claim 3 wherein said actuation means comprises:

a link member reciprocally mounted at a point along its length;

drive means for causing said link member to reciprocally displace at one end;

said link member aligned opposite and transverse to said tubular members of said first and second pumps along its length such that reciprocal displacement of said link member by said drive means causes said link member to compressibly contact said tubular members of said first and second pumps and release said contact.

7. An ink pad replenishing system as claimed in claim 6, further comprising thermo-responsive means for varying the compression of said tubular members by said link member of said first and second pumps in response to variation in ambient temperature.

* * * * *